United States Patent [19]

Boeckmann

[11] Patent Number: 4,712,684

[45] Date of Patent: Dec. 15, 1987

[54] BAG DISPENSING ARRANGEMENT

[75] Inventor: Hugo Boeckmann, Arlington Heights, Ill.

[73] Assignee: Minigrip, Inc., Orangeburg, N.Y.

[21] Appl. No.: 762,762

[22] Filed: Aug. 5, 1985

[51] Int. Cl.[4] ..... B65D 85/67

[52] U.S. Cl. ..... 206/554; 206/494; 221/45; 229/175; 383/37

[58] Field of Search ..... 206/390, 494, 554, 820; 221/33, 45, 46, 63, 210; 225/48, 49, 50, 52; 229/175; 383/37

[56] References Cited

U.S. PATENT DOCUMENTS

| | | | |
|---|---|---|---|
| 1,967,187 | 7/1934 | Dickson | 206/409 |
| 2758710 | 8/1956 | Arens | 229/175 |
| 2,923,435 | 2/1960 | Chaplin | 206/494 |
| 3,051,583 | 8/1962 | Tindall | 206/409 |
| 3,160,273 | 12/1964 | Reuther et al. | 206/390 |
| 3,229,876 | 1/1966 | Osborn | 225/49 |
| 3,285,405 | 11/1966 | Wanderer | 206/494 |
| 3,392,825 | 7/1968 | Gale et al. | 206/494 |
| 3,958,768 | 5/1976 | Fairbanks | 206/390 |
| 4,032,038 | 6/1977 | Hendricks et al. | 221/71 |
| 4,201,029 | 5/1980 | Lerner et al. | 206/494 |
| 4,416,376 | 11/1983 | Scheffers et al. | 206/554 |
| 4,567,984 | 2/1986 | Gietman, Jr. | 206/554 |

FOREIGN PATENT DOCUMENTS

| | | | |
|---|---|---|---|
| 2203292 | 8/1973 | Fed. Rep. of Germany | 221/45 |
| 0461755 | 1/1971 | Japan | 206/820 |
| 0314270 | 7/1956 | Switzerland | 206/494 |
| 0829216 | 3/1960 | United Kingdom | 206/820 |

*Primary Examiner*—Jimmy G. Foster

*Attorney, Agent, or Firm*—Hill, Van Santen, Steadman & Simpson

[57] ABSTRACT

A chain bag dispensing arrangement comprising a container housing a folded pack of unfilled chain bags connected by frangible links. The bags are adapted to be withdrawn seriatim through a dispensing slot in one wall of the container. Each succeeding bag may be braked against a surface along the slot, when partially withdrawn from the bag to facilitate separation of the lead bag by breaking of the link connecting them. A floating drag and holddown board lies on top of the bag pack. The pack may have one stack of fan folded bags or it may comprise a plurality of stacks wherein each fan folded layer has a plurality of bags.

7 Claims, 7 Drawing Figures

BAG DISPENSING ARRANGEMENT

This invention relates to a new and improved bag dispensing arrangement, and is more particularly concerned with seriatim dispensing of unfilled chain bags, that is, bags formed from plastic film and equipped with reclosable fastener means and wherein the bags are connected together at their sides by frangible link means so that the bags can be separated by snapping the links.

Small household packets of unconnected reclosable plastic bags are a regular retail commodity. Even though this type of bag is generally rather flimsy, small quantity packets are fairly convenient to handle the removal of one of the bags at a time without creating a disordered mess. In larger volume the bags will tend to become disorderly as the mass of the pack diminishes relative to the volume of the bag pack container and in the handling of the package and withdrawal of successive bags therefrom the handling and manipulation cause the bags to shift relative to one another.

So called chain bags are of the type wherein the separable fastener, i.e. zipper, equipped plastic bags are joined edge-to-edge by means of frangible links but are otherwise separated from one another. At least one link connecting contiguous bag side edges may be formed by fusibly thinning the extruded plastic separable fastener at each side joint. These chain bags are adapted to be packed in generally fan folded relation or accordian fashion in commercial quantities in containers from which the bag chains can be readily withdrawn for filling of the bags in bag filling machines. However, insofar as I am aware, supplying of chain bags of the kind described in convenience size packets for intermittent bag-by-bag dispensing, such as for household use, has not heretofore been attained or at least has not been attained in a satisfactory arrangement.

An important object of the present invention is to provide a new and improved chain bag dispensing arrangement, and more particularly for dispensing such bags intermittently one at a time.

Another object of the invention is to provide a new and improved method of packing chain bags for convenient dispensing.

A further object of the invention is to provide a new and improved method of dispensing chain bags.

In accordance with the principles of the present invention, there is provided a chain bag dispensing arrangement comprising a container within which is received a folded pack of unfilled chain bags connected by frangible links. A dispensing slot in one wall of the container provides means through which the bags can be pulled seriatim from the pack. Each succeeding bag may be braked against a surface along the slot, when partially withdrawn from the pack by a pull applied through the next preceding bag and the frangible link means connecting them, to facilitate separation of the lead bag from the succeeding bag by breaking of the link means connecting them.

The invention also provides a method of packing chain bag within a dispensing container in a manner to facilitate access to the bag chain for dispensing.

The present invention also provides a new and improved method of dispensing unfilled chain bags from a packet of the bags.

Other objects, features and advantages of the present invention will be readily apparent from the following description of certain preferred embodiments thereof, taken in conjunction with the accompanying drawing, although variations and modifications may be effected without departing from the spirit and scope of the novel concepts of the disclosure, and in which.

Figure 1:
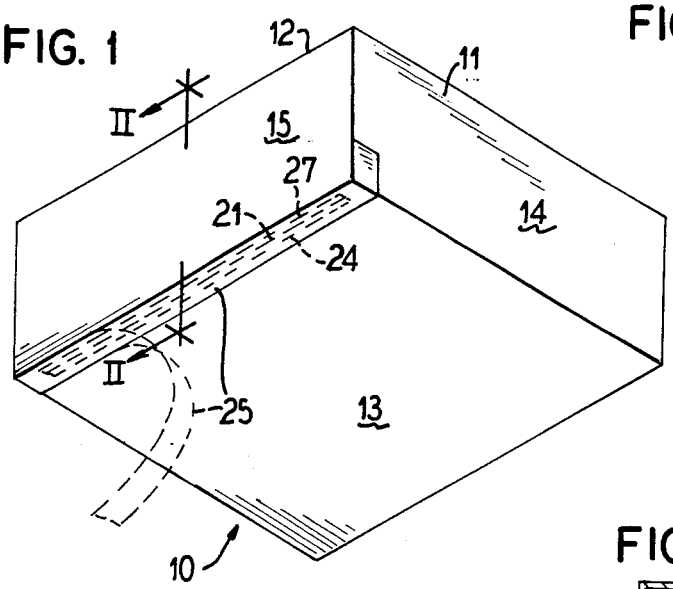
FIG. 1 is a bottom isometric view of a chain bag dispensing arrangement comprising a packet embodying the present invention.

Referring to FIGS. 1–4, a chain bag dispensing arrangement packet 10 comprises a container 11 of preferably rectangular form and made from self-sustaining material such as a suitable grade of box board where the container is intended to be disposable. On the other hand if the container 11 is to be refillable, it may be made of more durable material such as a plastic material which may be opaque or transparent, as may be preferred. In any event, the container 11 has a horizontal top wall 12, a horizontal bottom wall 13, opposite side walls 14 and identical front and back walls 15.

A pack 17 of flattened unfilled chain bags 18 is housed within the container 11. Each of the bags 18 is desirably formed from extruded plastic film having closed sides and bottom and openable at a top end. The openable top of each bag has a complementary profile, extruded, separable fastener of any preferred structure, commonly referred to as a zipper and of which there are a number of known constructions of either single tongue and groove or multiple rib and groove types. These bags may be produced from a continuous extrusion wherein the bag body film and the zipper are simultaneously extruded, or they may be of the type in which the bag body film and the zipper profiles are separately extruded and then joined in a desirable fashion. The bag material may be formed as a spread open ribbon which is folded upon itself, the zipper 19 separably interlocked, and the bags separated along their sealed sides, except for frangible link means which connect the contiguous sides of the bags in chain fashion.

Although the link means may comprise a plurality such as two links connecting each contiguous bag side edge, in one preferred form a single link may connect each side of each bag to the sides of its companion bags. The links 20 are desirably formed as fusion flattened connected ends of the zippers 19 of the bag, and the bags being otherwise separated from one another.

After formation, the bags 18 are fan folded upon one another to provide the pack 17. For this purpose the thin frangible connecting links 20 are readily hingedly bendable. The thickness of the pack 17 is determined by the number of bags 18 in the pack. This dimension and the length and width dimensions of the bags in the pack determines the various dimensions of the pack and which dimensions are calculated to be complementary within the housing defined by the container 11 so that the pack will be accommodated freely but closely enough within the container to avoid any significant planar misalignment of the bags relative to one another. At its upper face, the pack 17 confronts the top wall 12 of the container while at its opposite, bottom face the pack rests upon the bottom wall 13 of the container. Side edges of the pack confront the side walls 14 of the container, and at its front and rear ends the pack, i.e. the top and bottom ends of the bags, confronts the front and rear walls 15 of the container 11.

New and improved means are provided for dispensing the bags 18 seriatim from the container 11. For this purpose, the bottom wall 13 is provided along the lower edge of the front wall 15 with a dispensing slot 21 which is of a length and width to enable withdrawing therethrough of the bags 18 one after the other. In a practical construction, the dispensing slot 21 may be about 1/16th of an inch wide, and of a length slightly less, such as about ½ to 1 inch shorter than the width of the bags 18 to be dispensed through the slot. At its opposite ends, the slots is preferably equally spaced from the container side walls 14. Disposition of the pack 17 is preferably with the fasteners 20 parallel to the slot 21, and the integral frangible links connecting the fan folded bags 18 will thus lie adjacent to the side walls 14. By preference, the zippers 19 are, in the pack 17, disposed adjacent to the front wall 15 although they may be located adjacent to the rear wall 15 if desired.

For dispensing the bags 18, it is desirable to pull them from the top of the stacked bags in the pack 17 so as to minimize liability of consecutive bags sticking together when being pulled from the pack during dispensing. This might occur if the bags were pulled from the bottom of the pack, especially when the pack is full and thus the full weight of the pack would be imposed upon the lowermost bag in the pack at least at the commencement of dispensing from the package 10.

Figure 5:
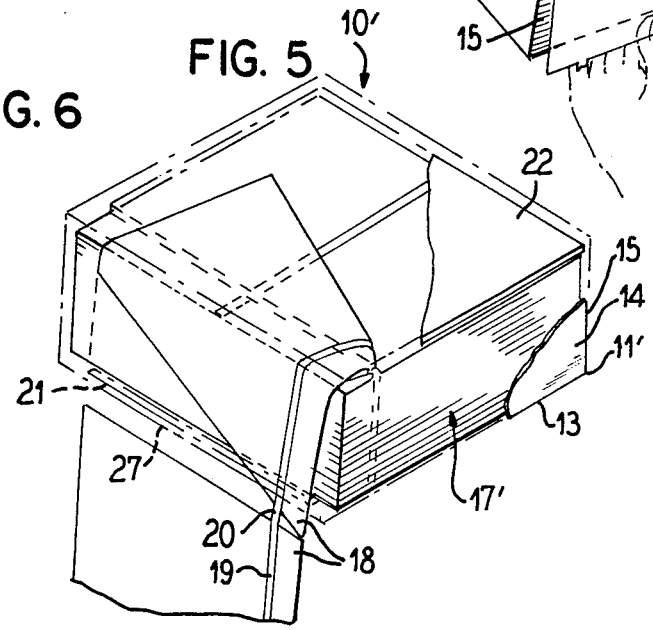
FIG. 5 is a more or less schematic view showing a dispensing arrangement for a dual pack of unfilled chain bags.

In the preferred arrangement, the successive bags extend from the pack down from the top of the pack between the front end of the pack and the front wall 15 (FIGS. 2, 3 and 5) and with the leading end of the lead, or preceding, bag 18 projecting out of the dispensing slot 21. For orderly feeding of the bags from the top of the pack, hold down means comprising a floating board 22 is provided to lie freely on top of the pack 17 under the top wall 12 of the container 11. In plan, the board 22 is dimensioned close to the plan dimensions within the container 11, but with the edges of the board in free clearance relation to the adjacent walls of the container so that the board can freely float down on the pack 17 as the pack diminishes during dispensing.

Another desirable function of the board 22 is to provide a mild frictional drag surface along which each successive bag must be advanced during dispensing. This avoids overrunning or spilling of the bags during dispensing such as if an unnecessarily vigorous jerk is applied when a preceding bag is pulled from the container 11 through the slot 21.

Additional overrun preventing drag is desirably provided by surfaces 23 defining the ends of the slot 21 which are adapted to engage the side edge portions of the bags 18 with moderate frictional drag effect.

For convenience in starting dispensing from the container 11 a leading, digitally manipulatable, tab portion 24 of the lead bag 18 is caused to project outwardly from the slot 21. In the packet 10 as supplied, for example as a retail sales item, the starter tab 24 desirably comprises the closed bottom end of the lead bag 18. This initially provides a uniform width tab which lends itself to a desirably dual function retention scheme which conveniently comprises releasably attaching the tab 24 to the adjacent surface of the bottom wall 13 of the container as by means of a pressure sensitive adhesive tape 25. This tape 25 is desirably wider and longer than the tab 24 so that it will fully overlap the tab 24 and extend all around beyond the opposite longitudinal edges and ends of the tab and engage the adjacent container surfaces provided by the bottom wall 13 and the lower edge of the front wall 15. Thereby, the tape 25 will not only fully engage and enclose and retain the tab 24, but will also bridge across and close the slot 21. At its opposite ends the tape 25 may extend over onto the adjacent portions of the side walls 14. Through this arrangement the tape 25 serves as a holddown maintaining the tab 24 flat against the bottom wall 13, and thus safely maintains the tab against being accidentally engaged and pulled. In addition, the tape 25 serves as a tamper-proof closure for the tab 24, because if the initial tab 24 is not neatly in full untampered packet order, or the tape 25 is missing, before the packet has been sold or otherwise allocated to a legitimate user, tampering with the packet will be evident. However, a legitimate user may easily strip the safety tape 25 from the container and from the tab 24 for initiating dispensing.

Figure 2:
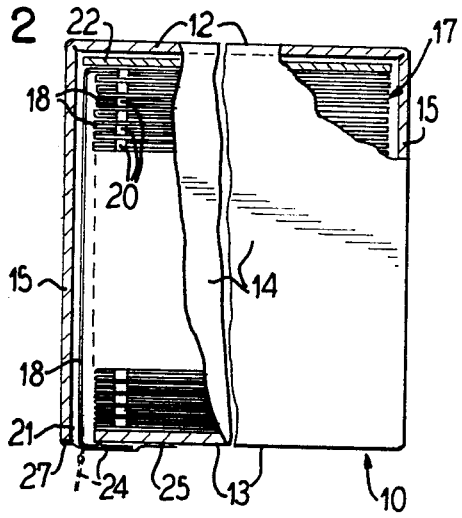
FIG. 2 is an enlarged fragmentary vertical sectional detail view taken substantially along the line II—II in FIG. 1.
Figure 3:
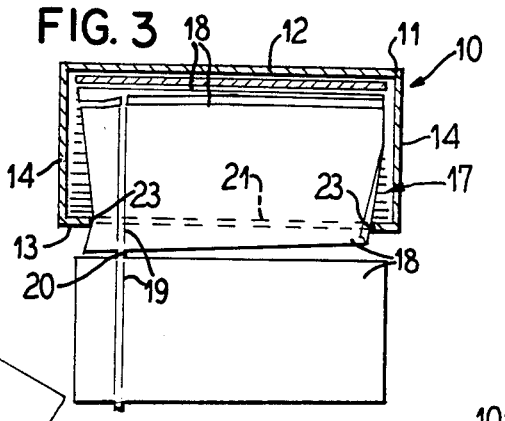
FIG. 3 is a reduced scale front sectional elevational view of the packet with the front wall removed.

After the tape 25 has been removed, the starting tab 24 will tend to project away from the container bottom 13, as indicated in dash outline in FIG. 2, for convenient grasping as between the thumb and forefinger of the user who may then pull the lead bag 18 from the container through the slot 21 until the next succeeding bag is partially withdrawn from the pack by pulling applied through the lead bag and the frangible link 20 connecting the bags. This action is exemplified in FIGS. 3 and 4 wherein it will be noted that the partially pulled out portion of the next succeeding bag now provides a pull tab for grasping and pulling that bag from the container.

Figure 4:
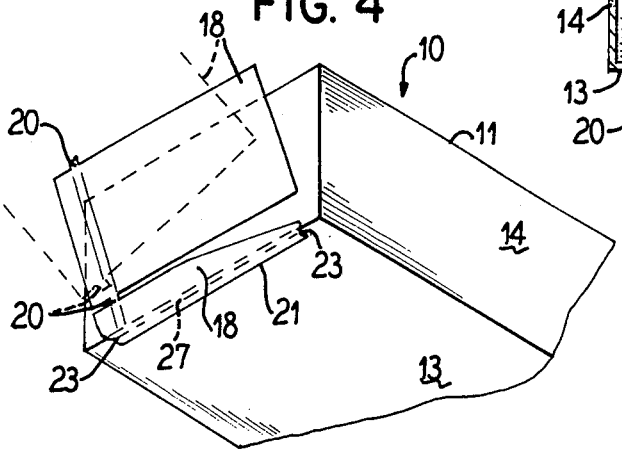
FIG. 4 is an isometric view similar to FIG. 1, but showing a bag being pulled from the pack within the packet.

After the lead bag 18 in each instance has been fully withdrawn from the container 11, it can be readily detached from the succeeding bag by braking the projecting or tab portion of the next succeeding bag against vertically facing shoulder edge surface 27 provided by the front wall 15 alongside the slot 21, substantially as exemplified in FIG. 4, and by an upward jerk applied to the lead bag snapping it free from the succeeding bag by breaking of the frangible connecting link 20 by which the bags are connected. After the lead bag has been separated, the relatively narrow outwardly projecting tab portion of the succeeding bag can be readily digitally grasped and such bag withdrawn and separated in a repetition of the dispensing cylce.

Whereas the packet 10 of FIGS. 1–4 is shown as intended particularly for dispensing bags from a single stack of accordian or fan folded of bags in the pack 17, the invention is readily adaptable for a plural stack packet 10' (FIG. 5) wherein the chain bags 18 are fan folded in a manner to provide a plurality of stacks, herein shown as two in the pack 17', but which could just as well be three or more, depending on the practicality of bag size and handling convenience. Except for the larger size to accommodate the multistack configuration of the pack 17' of bags, the container 11' may be identical in structure to the container 11, and therefore identical reference numerals will identify identical elements. Dispensing of the bags 18 from the multistack pack 17' is effected the same as described for dispensing the single stack pack 17. That is, the bags 18 are adapted to be withdrawn one at a time and the tab portion of the next succeeding bag is adapted to be stopped and braked against the edge surface 27 alongside the slot 21 in the bottom wall of the container 15 and the lead bag then snapped free from the succeeding bag by breaking of the frangible link 20 connecting the bags.

Figure 6:
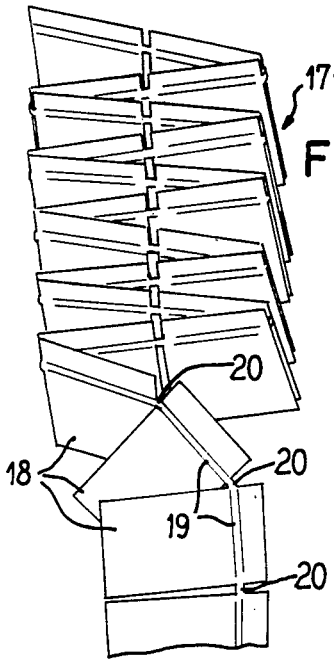
FIG. 6 is a schematic view exemplifying the packing and dispensing of the chain bags in dual pack.

By way of example, attention is directed to schematic FIG. 6 which depicts the fan folding order of the multistack pack of bags, and then how the bag are adapted to be successively drawn from the pack for dispensing. It will be understood, of course, that in a sense the multistack fan folding scheme depicted may also be taken as exemplary of the single stack fan folding wherein instead of a plurality of bags in each fan fold layer, there is a single bag in each fan fold layer.

Figure 7:
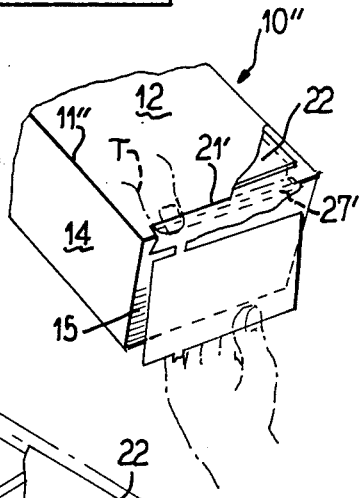
FIG. 7 a top isometric view of a modified chain bag dispensing pack embodying the invention.

If preferred, a top dispensing packet 10'' (FIG. 7) may be provided in contrast to the bottom dispensing packets already described. In the packet 10'', the container 11'' may be of substantially the same construction as already described, except that the dispensing slot 21' is formed in the top wall 12 instead of the bottom wall of the container. All other structure may be identical as that described for the container 11. In the packet 10'' the floating holddown board 22 has its foward edge adjacent to but clear of the dispensing slot 21'' so that as the bags 18 are successively withdrawn they will issue past the front edge of the floating board 22 and leave directly through the adjacent dispensing slot 21', instead of travelling down along the front of the pack of bags. Further, although it may be sufficient to jerk downwardly on the fully withdrawn lead bag 18 to snap it loose from the succeeding bag, it may be convenient to stop-snag the projecting tab portion of the next succeeding bag as by means of a thumb T pressing it against the snag surface 27' provided by the upper vertically facing edge of the front wall 15 along the dispensing slot 21'.

It will be understood that although the container in each described instance is shown more or less schematically, it may, aside from the dispensing slot, embody any suitable conventional construction which will permit loading the container with the desired bag stack and the holddown board 22, whereafter the container is preferably permanently closed in a preferred manner.

It will also be understood that insofar as the bags 18 are concerned, they may be constructed from any suitable material. However the particular arrangements described are especially well adapted for bags made from plastic materials.

It will be understood that variations and modifications may be effected without departing from the spirit and scope of the novel concepts of the present invention.

I claim as my invention:

1. A chain bag dispensing arrangement, comprising a packet having:

a container defining a housing having a bottom wall;

a pack of unfilled chain bags within said container, said bags being connected by frangible link means;

said bottom wall having a slot along one edge of the pack;

said bags being guided from the top the stack and down between said edge of the pack and a vertical wall of the container to said slot; and said slot having surface means so that each succeeding bag can be braked and stopped when partially withdrawn from the pack by pull applied through a lead bag and the frangible link means connecting the lead bag to the succeeding bag then broken to separate the lead bag from the next succeeding bag.

2. A chain bag dispensing arrangement, comprising a packet having:

a container providing a housing and having a bottom wall and a vertical wall;

a pack within the container housing of flattened unfilled chain bags having separable fasteners connected by frangible means and the bags disposed in a fan folded stack which substantially fills said housing and is supported on said bottom wall;

said stack having an edge confronting said vertical wall;

said bottom wall having a dispensing slot generally aligned with said edge of said stack and said vertical wall;

and said bags being guided from the top of the stack downwardly between said stack edge and said vertical wall to said slot to be pulled seriatim from said pack through said slot and separated from one another by breaking said frangible means.

3. A chain bag dispensing arrangement according to claim 2, wherein said stack has its top under a top wall of said container, and a floating holddown board lying on top of the stack under said top wall.

4. A chain bag dispensing arrangement according to claim 2, including a surface along said slot and at the lower edge of said vertical wall and against which surface leading ends of succeeding bags of the chain, after being partially withdrawn from the stack through said slot by a pull applied through a lead bag and the frangible means connecting them, can be stopped and braked to facilitate separation of the lead bag from the succeeding bag by breaking of the frangible connecting means.

5. A chain bag dispensing arrangement, comprising a packet having:

a container defining a housing having spaced horizontal walls and a vertical front wall;

a pack of unfilled chain bags within the container housing;

flangible link means connecting said bags end-to-end into a chain;

one of said horizontal walls having a dispensing slot contiguous to said front wall so that a vertically facing free edge of said front wall provides an unobstructed front edge along said slot over which said bags can be pulled seriatim from said pack;

said edge being a stop shoulder against which each succeeding bag can be bracked and stopped by thrusting the succeeding bag against the edge stop shoulder, when partially withdrawn from the pack by a pull applied through a lead bag, and the frangible link means connecting the lead bag to the succeeding bag broken to effect separation of the lead bag from the succeeding bag as a result of continued pulling on said lead bag while said succeeding bag is stopped against said edge stop shoulder; and said chain bags having resiliently flexible separable fasteners extending from side-to-side and extending parallel to said slot.

6. A chain bag dispensing arrangement, comprising a packet having:

a container defining a housing having spaced horizontal walls and a vertical front wall;

a pack of unfilled chain bags within the container housing;

frangible link means connecting said bags end-to-end into a chain;

one of said horizontal walls having a dispensing slot contiguous to said front wall so that a vertically facing free edge of said front wall provides an unobstructed front edge along said slot over which said bags can be pulled seriatim from said pack;

said edge being a stop shoulder against which each succeeding bag can be braked and stopped by thrusting the succeeding bag against the edge stop shoulder, when partially withdrawing from the pack by a pull applied through a lead bag, and the frangible link means connecting the lead bag to the succeeding bag broken to effect separation of the lead bag from the succeeding bag as a result of continued pulling on said lead bag while said succeeding bag is stopped against said edge stop shoulder;

said one wall being the bottom wall of the container and said pack of chain bags being supported on said bottom wall;

said slot being in said bottom wall along one edge of the pack; and said bags being guided from the top of the stack down between said edge of the pack and said vertical front wall of the container to said slot.

7. A chain bag dispensing arrangement according to claim 5, wherein said frangible link means comprise heat flattened links connecting the separable fastener in end-to-end relation.

* * * * *